US005604479A

United States Patent [19]

Chang

[11] Patent Number: 5,604,479

[45] Date of Patent: Feb. 18, 1997

[54] VOICE RECORDING AND PLAYBACK APPARATUS, AND ALARM SYSTEM WITH VOICE RECORDING AND PLAYBACK APPARATUS

[76] Inventor: Yen-Pin Chang, 3F, No. 18, Lane 100, Sung-chiang Rd., Taipei, Taiwan

[21] Appl. No.: 620,301

[22] Filed: Mar. 22, 1996

[51] Int. Cl.[6] ..... G08B 3/10

[52] U.S. Cl. ..... 340/384.7; 360/5; 360/6; 340/692; 340/460

[58] Field of Search ..... 340/384.7, 692, 340/460, 531; 360/5, 6

[56] References Cited

U.S. PATENT DOCUMENTS 4,560,978 12/1985 Lemelson ..... 340/539
4,652,859 3/1987 Van Wienen ..... 340/503

*Primary Examiner*—Jeffery Hofsass
*Assistant Examiner*—Daryl C. Pope
*Attorney, Agent, or Firm*—Foley & Lardner

[57] ABSTRACT

A voice recording and playback apparatus includes a memory unit having addressable memory regions, a voice input unit for converting a user voice input into an electrical signal, and a processor for storing the electrical signal from the voice input unit as a voice message in the memory unit. A recording address generator, which includes a recording address decoder and a plurality of recording switches for connecting a respective input of the recording address decoder to a voltage source, provides a corresponding recording address to the processor to enable the latter to store the voice message in a corresponding one of the memory regions of the memory unit when one of the recording switches is closed. A playback address generator, which includes a playback address decoder and a plurality of playback switches for connecting a respective input of the playback address decoder to the voltage source, provides a corresponding playback address to the processor to enable the latter to retrieve the voice message in a corresponding one of the memory regions of the memory unit when one of the playback switches is closed. An alarm system which incorporates the voice recording and playback apparatus is also disclosed.

4 Claims, 3 Drawing Sheets

VOICE RECORDING AND PLAYBACK APPARATUS, AND ALARM SYSTEM WITH VOICE RECORDING AND PLAYBACK APPARATUS

BACKGROUND OF THE INVENTION

1. Field of the Invention

The invention relates to a voice recording and playback apparatus, more particularly to a voice recording and playback apparatus which can be used in an alarm system.

2. Description of the Related Art

Referring to FIG. 1, a conventional alarm system is shown to include normally open (N.O.) microswitches 11, 12, 13, 14 to be installed in locations that require security for detecting the presence of a burglar. Each of the microswitches 11, 12, 13, 14 is connected in series to a respective relay 15, 16, 17, 18 and to a respective alarm lamp 19, 20, 21, 22. The relays 15, 16, 17, 18 and the alarm lamps 19, 20, 21, 22 are connected to a common alarm device 23. A power supplying device 24 supplies the electrical power that is required by the alarm system when a power switch 25 is closed.

In operation, when any of the microswitches 11, 12, 13, 14 is closed, i.e. a burglar is detected, the respective relay 15, 16, 17, 18 is energized, thus activating the alarm device 23 so as to generate an audible alarm output. The respective alarm lamp 19, 20, 21, 22 lights up at the same time.

Usually, the alarm device 23 generates a ringing or buzzing alarm output. If a relatively large number of microswitches is in use, the alarm device 23 can only provide information concerning the presence of a burglar but not the whereabouts of the burglar.

SUMMARY OF THE INVENTION

Therefore, the object of the present invention is to provide a voice recording and playback apparatus which can be used in an alarm system so as to overcome the aforementioned drawback that is associated with the prior art.

According to one aspect of the present invention, a voice recording and playback apparatus comprises:

a memory unit having addressable memory regions;

a voice input unit for converting a user voice input into an electrical signal;

processor means, connected to the memory unit and the voice input unit, for storing the electrical signal from the voice input unit as a voice message in the memory unit;

a recording address generator including a recording address decoder which has a plurality of inputs and an output end connected to the processor means, and a plurality of recording switches for connecting a respective one of the inputs of the recording address decoder to a voltage source, the recording address decoder providing a corresponding recording address to the processor means to enable the processor means to store the voice message in a corresponding one of the memory regions of the memory unit when one of the recording switches is closed;

a playback address generator including a playback address decoder which has a plurality of inputs and an output end connected to the processor means, and a plurality of playback switches for connecting a respective one of the inputs of the playback address decoder to the voltage source, the playback address decoder providing a corresponding playback address to the processor means to enable the processor means to retrieve the voice message in a corresponding one of the memory regions of the memory unit when one of the playback switches is closed;

amplifier means, connected to the processor means, for amplifying the voice message retrieved by the processor means; and speaker means, connected to the amplifier means, for broadcasting the voice message retrieved by the processor means.

According to another aspect of the present invention, an alarm system comprises the voice recording and playback apparatus, a thyristor set and a detector unit. The thyristor set includes a plurality of thyristors, each of which has a first thyristor terminal connected to a respective one of the inputs of the playback address decoder, a second thyristor terminal connected to the voltage source, and a trigger input. The detector unit includes a plurality of alarm switches, each of which connects the trigger input of a respective one of the thyristors to the voltage source. Closure of one of the alarm switches triggers the respective one of the thyristors into conduction, thereby connecting one of the inputs of the playback address decoder to the voltage source.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
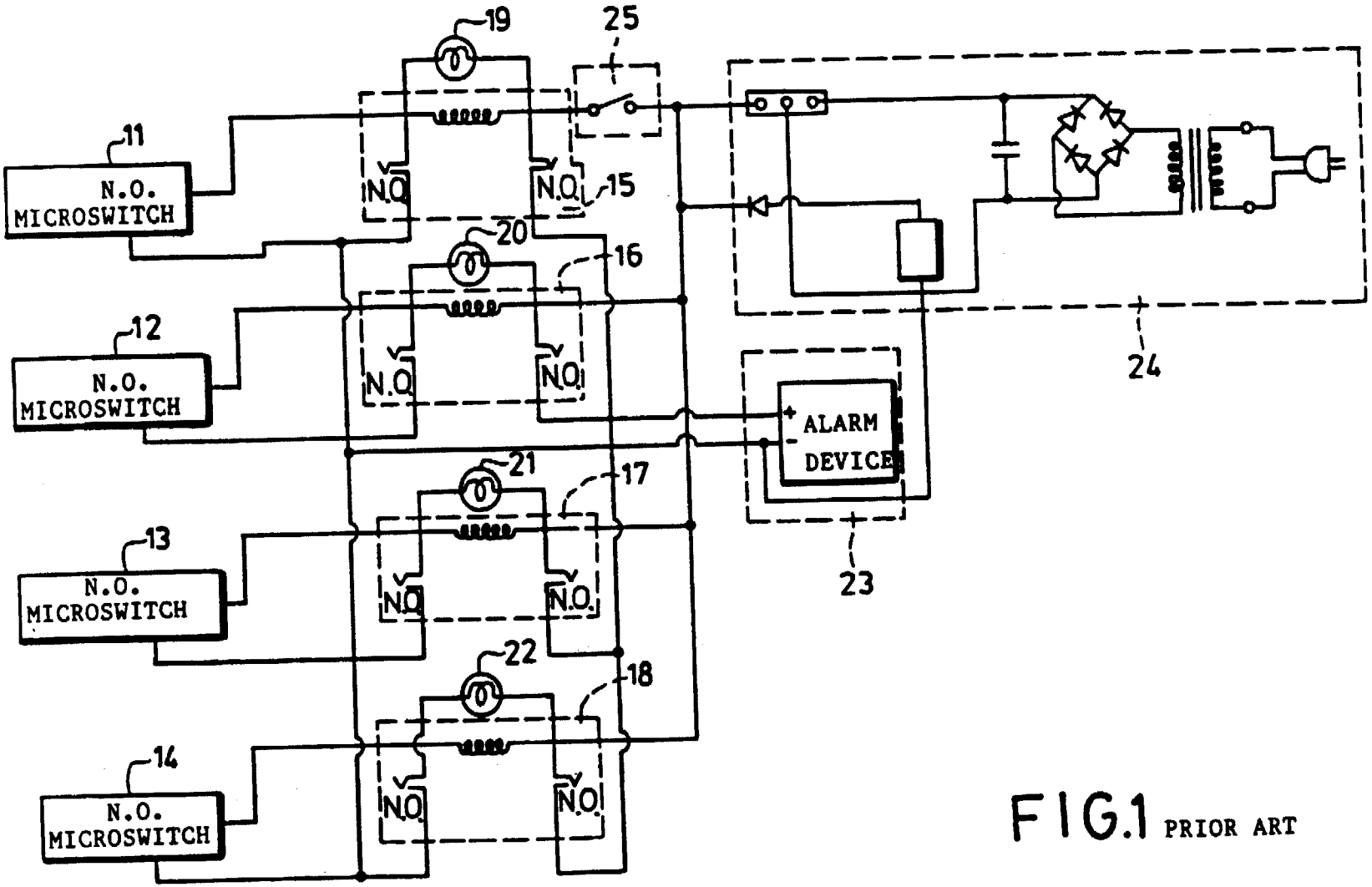
FIG.1 PRIOR ART
FIG. 1 is a circuit diagram of a conventional alarm system.
Figure 2:
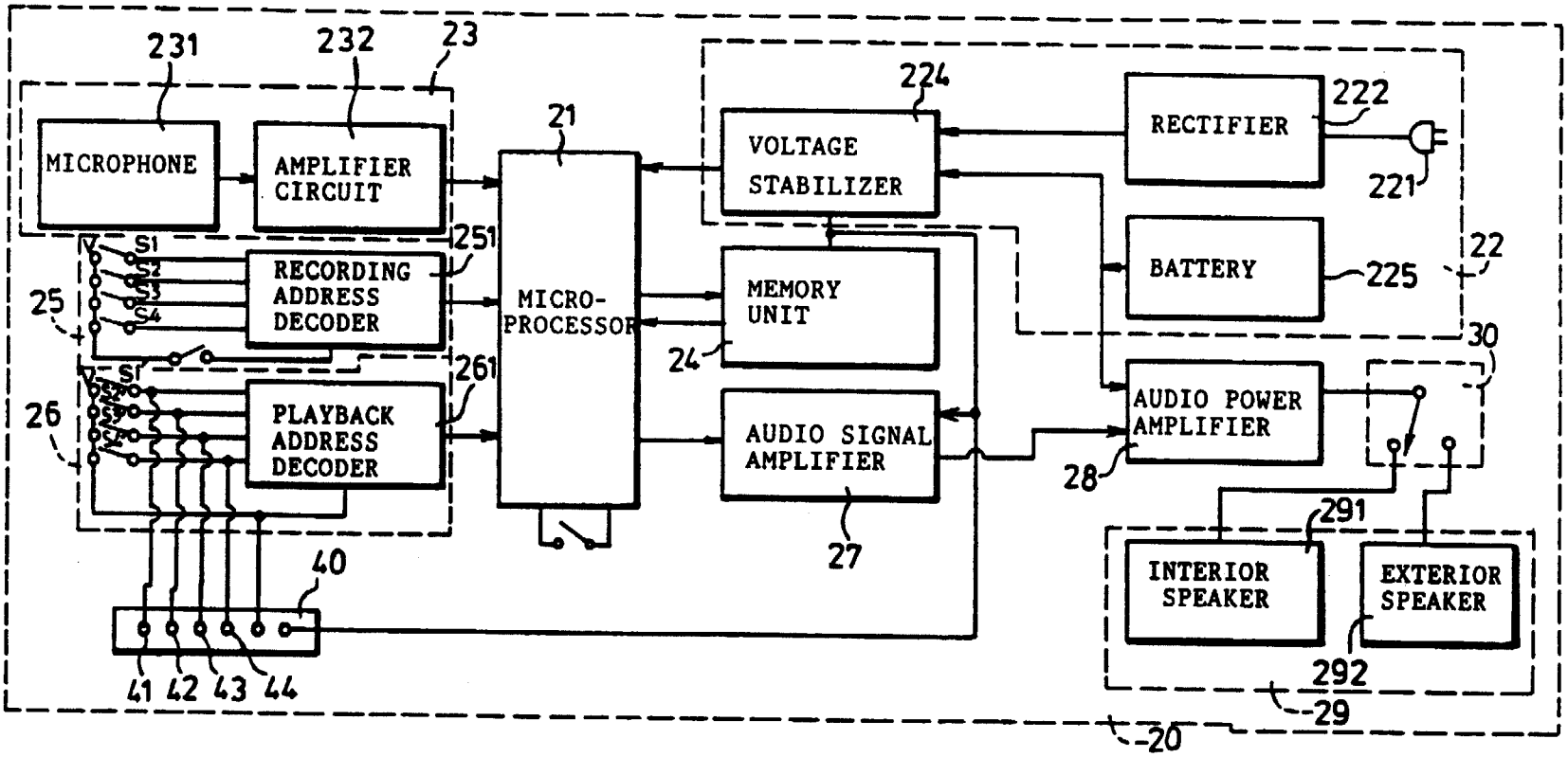
FIG. 2 is a schematic circuit block diagram of the preferred embodiment of a voice recording and playback apparatus according to the present invention.

Referring to FIG. 2, the preferred embodiment of a voice recording and playback apparatus 20 according to the present invention is shown to comprise a microprocessor 21, a power supplying device 22, a voice input unit 23, a memory unit 24, a recording address generator 25, a playback address generator 26, an audio signal amplifier 27, an audio power amplifier 28, and a speaker unit 29.

The power supplying device 22 supplies the required electrical power and includes a plug 221 for connection with an electrical outlet (not shown), a rectifier 222 connected to the plug 221, a voltage stabilizer 224 connected to the rectifier 222, and a reserve power source, such as a battery 225. AC line power from the plug 221 is rectified by the rectifier 222 and is converted into a stable DC voltage output by the voltage stabilizer 224. The battery 225 provides the DC voltage output when AC line power is unavailable to ensure round-the-clock operation of the apparatus 20.

The memory unit 24 is connected to the microprocessor 21 and has a plurality of addressable memory regions for storing different voice messages therein.

The voice input unit 23 includes a microphone 231 and an amplifier circuit 232. The microphone 231 converts a user voice input into an electrical signal which is amplified by the amplifier circuit 232 and which is received by the microprocessor 21.

The recording address generator 25 includes a plurality of recording switches S1, S2, S3, S4. In this embodiment, there are four recording switches S1, S2, S3, S4 although the number of recording switches can preferably be expanded to 128. The recording switches S1, S2, S3, S4 connect inputs of a recording address decoder 251 to a voltage source (V). The recording address generator 251, in turn, has an output end connected to the microprocessor 21. Whenever one of the recording switches S1, S2, S3, S4 is closed, the recording address decoder 251 provides a corresponding recording address to the microprocessor 21, thereby enabling the microprocessor 21 to store the electrical signal from the voice input unit 23 as a voice message in a corresponding one of the memory regions of the memory unit 24.

The playback address generator 26 includes a plurality of playback switches S1', S2', S3', S4', the number of which corresponds to the number of recording switches S1, S2, S3, S4. The playback switches S1', S2', S3', S4' connect inputs of a playback address decoder 261 to the voltage source (V). The playback address decoder 261, in turn, has an output end connected to the microprocessor 21. Whenever one of the playback switches S1, S2, S3, S4 is closed, the playback address decoder 261 provides a corresponding playback address to the microprocessor 21, thereby enabling the microprocessor 21 to retrieve the voice message stored in a corresponding one of the memory regions of the memory unit 24.

The audio signal amplifier 27 is connected to the microprocessor 21 and amplifies the voice message which was retrieved by the microprocessor 21 from the memory unit 24. The output of the audio signal amplifier 27 is received by the audio power amplifier 28 which, in turn, is connected to the speaker unit 29 via a select switch 30.

The speaker unit 29 includes an interior speaker 291 to be installed inside a building structure, and an exterior speaker 292 to be installed outside a building structure. The select switch 30 is operable so as to connect a selected one of the interior and exterior speakers 291, 292 to the audio power amplifier 28. The exterior speaker 292 is usually selected when nobody is inside the building structure.

In use, when recording a voice message in a first memory region of the memory unit 24, the first recording switch S1 is closed, thereby enabling the recording address decoder 251 to provide a first recording address to the microprocessor 21. Upon reception of the first recording address, the microprocessor 21 stores the electrical signal from the voice input unit 23 as a voice message in the first memory region of the memory unit 24. Recording of voice messages in the other memory regions of the memory unit 24 is done in a similar manner and will not be detailed further.

When it is desired to playback the voice message in the first memory region of the memory unit 24, the first playback switch S1' is closed, thereby enabling the playback address decoder 261 to provide a first playback address to the microprocessor 21. Upon reception of the first playback address, the microprocessor 21 retrieves the voice message stored in the first memory region of the memory unit 24 and provides the same to the audio signal amplifier 27. The voice message is further amplified by the audio power amplifier 28 before being broadcast by the speaker unit 29. Playback of the voice messages in the other memory regions of the memory unit 24 is done in a similar manner and will not be detailed further.

Preferably, the apparatus 20 further comprises a connector 40 having a plurality of connector terminals 41, 42, 43, 44 connected respectively to the inputs of the playback address decoder 261. The connector 40 permits use of the apparatus 20 in an alarm system, as will be described in the succeeding paragraphs.

Figure 3:
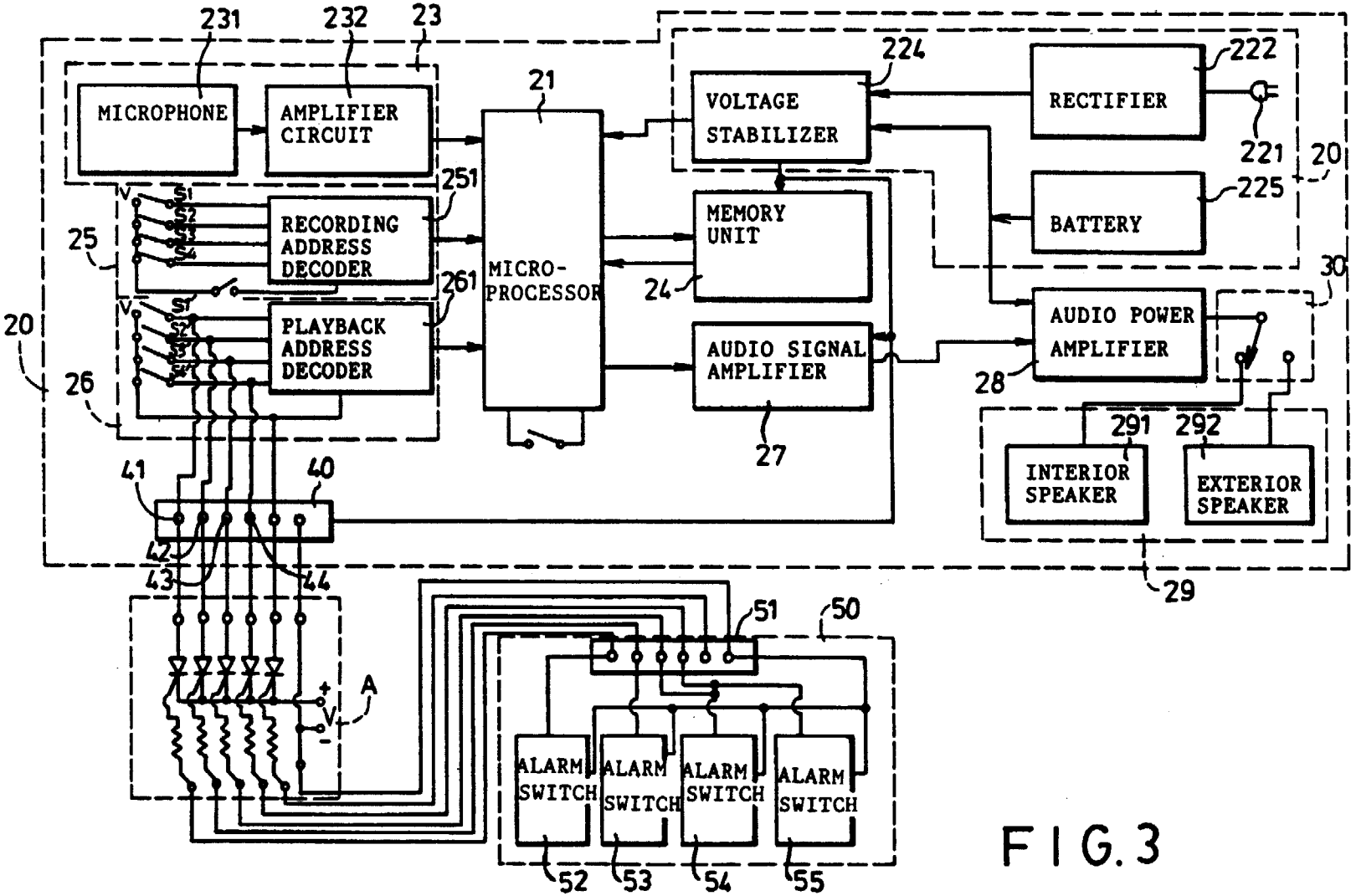
FIG. 3 is a schematic circuit block diagram of the preferred embodiment of an alarm system with the voice recording and playback apparatus of the present invention.

FIG. 3 illustrates an alarm system which incorporates the voice recording and playback apparatus 20 of the preferred embodiment. As shown, the alarm system further includes a thyristor set (A) and a detector unit 50. The thyristor set (A) includes a plurality of thyristors, each of which has a first thyristor terminal connected to a respective one of the connector terminals 41, 42, 43, 44, a second thyristor terminal connected to the voltage source (V), and a trigger input. In this embodiment, each of the thyristors is a silicon controlled rectifier (SCR). The detector unit 50 includes a connector 51 which has a plurality of connector terminals connected to the trigger input of a respective one of the thyristors, and a plurality of alarm switches 52, 53, 54, 55 which connect a respective one of the connector terminals of the connector 51 to the voltage source (V). Thus, each of the alarm switches 52, 53, 54, 55 can connect a respective one of the inputs of the playback address decoder 261 to the voltage source (V) via the connectors 40, 51 and the thyristor set (A).

The alarm switches 52, 53, 54, 55 can be installed in different locations of a building. For example, the first, second third and fourth alarm switches 52, 53, 54, 55 can be installed at the front door, the back door, the front window and the rear window of the building. In this example, the voice messages "There is a burglar at the front door," "There is a burglar at the back door," "There is a burglar at the front window," and "There is a burglar at the rear window" are stored in the first, second, third and fourth memory regions of the memory unit 24, respectively. Thus, when a burglar enters the front door, the first alarm switch 52 is closed, thereby connecting the trigger input of a first thyristor of the thyristor set (A) to the voltage source (V). The first thyristor conducts, thereby connecting a first input of the playback address decoder 261 to the voltage source (V). At this time, the microprocessor 21 retrieves the voice message "There is a burglar at the front door" from the first memory region of the memory unit 24, and the retrieved voice message is processed by the audio signal amplifier 27 and the audio power amplifier 28 before being broadcast by the speaker unit 29.

In the foregoing example, the alarm switches 52, 53, 54, 55 are installed in a building. The alarm switches 52, 53, 54, 55 may, however, be installed in different parts of a car, such as the car doors, the trunk, the hand brake, etc. Thus, the apparatus 20 may be used to provide information to the driver concerning the status, i.e. whether opened or closed, of the different parts of the car.

It has thus been shown that the apparatus 20 of the present invention can be used to record and playback voice messages and can be further incorporated in an alarm system so as to provide information concerning the presence and location of a burglar. The object of the present invention is thus met.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A voice recording and playback apparatus, comprising:

a memory unit having addressable memory regions;

a voice input unit for converting a user voice input into an electrical signal;

processor means, connected to said memory unit and said voice input unit, for storing the electrical signal from said voice input unit as a voice message in said memory unit;

a recording address generator including a recording address decoder which has a plurality of inputs and an output end connected to said processor means, and a plurality of recording switches for connecting a respective one of said inputs of said recording address decoder to a voltage source, said recording address decoder providing a corresponding recording address to said processor means to enable said processor means to store the voice message in a corresponding one of said memory regions of said memory unit when one of said recording switches is closed;

a playback address generator including a playback address decoder which has a plurality of inputs and an output end connected to said processor means, and a plurality of playback switches for connecting a respective one of said inputs of said playback address decoder to the voltage source, said playback address decoder providing a corresponding playback address to said processor means to enable said processor means to retrieve the voice message in a corresponding one of said memory regions of said memory unit when one of said playback switches is closed;

amplifier means, connected to said processor means, for amplifying the voice message retrieved by said processor means; and speaker means, connected to said amplifier means, for broadcasting the voice message retrieved by said processor means.

2. The voice recording and playback apparatus as claimed in claim 1, further comprising a connector which has a plurality of connector terminals connected respectively to said inputs of said playback address decoder.

3. An alarm system, comprising:

a voice recording and playback apparatus including:

a memory unit having addressable memory regions;

a voice input unit for converting a user voice input into an electrical signal;

processor means, connected to said memory unit and said voice input unit, for storing the electrical signal from said voice input unit as a voice message in said memory unit;

a recording address generator including a recording address decoder which has a plurality of inputs and an output end connected to said processor means, and a plurality of recording switches for connecting a respective one of said inputs of said recording address decoder to a voltage source, said recording address decoder providing a corresponding recording address to said processor means to enable said processor means to store the voice message in a corresponding one of said memory regions of said memory unit when one of said recording switches is closed;

a playback address generator including a playback address decoder which has a plurality of inputs and an output end connected to said processor means, and a plurality of playback switches for connecting a respective one of said inputs of said playback address decoder to the voltage source, said playback address decoder providing a corresponding playback address to said processor means to enable said processor means to retrieve the voice message in a corresponding one of said memory regions of said memory unit when one of said playback switches is closed;

amplifier means, connected to said processor means, for amplifying the voice message retrieved by said processor means; and speaker means, connected to said amplifier means, for broadcasting the voice message retrieved by said processor means;

a thyristor set including a plurality of thyristors, each of which has a first thyristor terminal connected to a respective one of said inputs of said playback address decoder, a second thyristor terminal connected to the voltage source, and a trigger input; and a detector unit including a plurality of alarm switches, each of which connects said trigger input of a respective one of said thyristors to the voltage source;

whereby, closure of one of said alarm switches triggers the respective one of said thyristors into conduction, thereby connecting one of said inputs of said playback address decoder to the voltage source.

4. The alarm system as claimed in claim 3, wherein each of said thyristors is a silicon controlled rectifier.

* * * * *